United States Patent [19]

Saito et al.

[11] Patent Number: 4,465,183

[45] Date of Patent: Aug. 14, 1984

[54] TWO-PART LIQUID CONTAINER WITH BREAKABLE PARTITION

[75] Inventors: Tadao Saito; Shigeo Iizuka, both of Tokyo, Japan

[73] Assignee: Kao Soap Co., Ltd., Tokyo, Japan

[21] Appl. No.: 515,013

[22] Filed: Jul. 18, 1983

[30] Foreign Application Priority Data

Jul. 19, 1982 [JP] Japan ..... 57-109288[U]
Apr. 27, 1983 [JP] Japan ..... 58-63388[U]

[51] Int. Cl.[3] ..... B65D 25/08; B65D 1/04
[52] U.S. Cl. ..... 206/222; 215/DIG. 8
[58] Field of Search ..... 206/219, 222; 219/DIG. 8

[56] References Cited

U.S. PATENT DOCUMENTS 3,347,410 10/1967 Schwartzman ..... 206/222
3,397,694 8/1968 Ogle ..... 206/222
3,425,598 2/1969 Kobernick ..... 206/222
3,429,429 2/1969 Poitras ..... 206/222
3,810,469 5/1974 Hurschman ..... 206/222
3,840,136 10/1974 Lanfranconi et al. ..... 206/222
3,970,068 7/1976 Sato ..... 206/222

*Primary Examiner*—Joseph Man-Fu Moy
*Attorney, Agent, or Firm*—Parkhurst & Oliff

[57] ABSTRACT

A two-part liquid container with a breakable partition which has a first half container sealing a sheet at a neck portion thereof for containing a first liquid; an intermediate cylindrical member for connecting a cylindrical sealing piece through a collapsible piece at a lower end thereof spirally engaging the lower half end thereof with the outer periphery of the neck portion of the first half container; a second half container sealing a sheet at the bottom opening thereof and having a cutting blade depending toward the vicinity of the bottom therein for engaging the lower part thereof impossible to turn with the upper half part of the intermediate member; and a sealing member for sealing the upper opening of the second half container. Thus two liquid can be readily mixed without necessity for a particular mixing container to prevent overflowing the liquid.

12 Claims, 6 Drawing Figures

TWO-PART LIQUID CONTAINER WITH BREAKABLE PARTITION

BACKGROUND OF THE INVENTION

This invention relates to a two-part liquid container with a breakable partition for mixing two liquids by transferring one of the liquids contained in one container into the other container containing the other of the liquids by a simple operation for merely spirally twisting the one container to the other container.

A solution used for hair coloring or a permanent wave is, for example, prepared by mixing two liquids of different types. In this case, there is a trend to overflow the liquid a while transferring the liquid from the port of one container to the other container through the port of the other container. It is considered possible to mix two liquids of suitable quantities by preparing the liquids in another container, but then it is necessary to prepare another container. In any case, it is complicated and inconvenient to transfer the liquid from one container to another container. This is particularly true when hair coloring is frequently performed at home.

SUMMARY OF THE INVENTION

Accordingly, an object of the present invention is to provide a two-part liquid container with a breakable partition which can simply mix two liquids without preparation of another mixing container nor overflow of the liquid by simply devising the containers for the two liquids to be mixed.

BRIEF DESCRIPTION OF THE DRAWINGS

The above and other related objects and features of the invention will be apparent from a reading of the following description of the disclosure found in the accompanying drawings and the novelty thereof pointed out in the appended claims.

FIGS. 1 to 3 are views showing first embodiment of a two-part liquid container with a breakable partition according to the present invention; wherein FIG. 1 is a vertical sectional view of the half of the container;

FIG. 2 is a partial perspective view of outer periphery of the second half of the container of the present invention, and FIG. 3 is a partial perspective view of the inner periphery of the intermediate cylindrical member forming the container of the present invention;

FIGS. 4 to 6 are views showing second embodiment of the two-part liquid container according to the present invention, wherein FIG. 4 is a vertical sectional view of the half of the container, FIG. 5 is a view showing the operating state of the container shown in FIG. 4; and FIG. 6 is a vertical sectional view of the container taken along the line VI—VI in FIG. 5.

DESCRIPTION OF THE PREFERRED EMBODIMENTS

The present invention will now be described in more detail with reference to the accompanying drawings.

Figure 1:
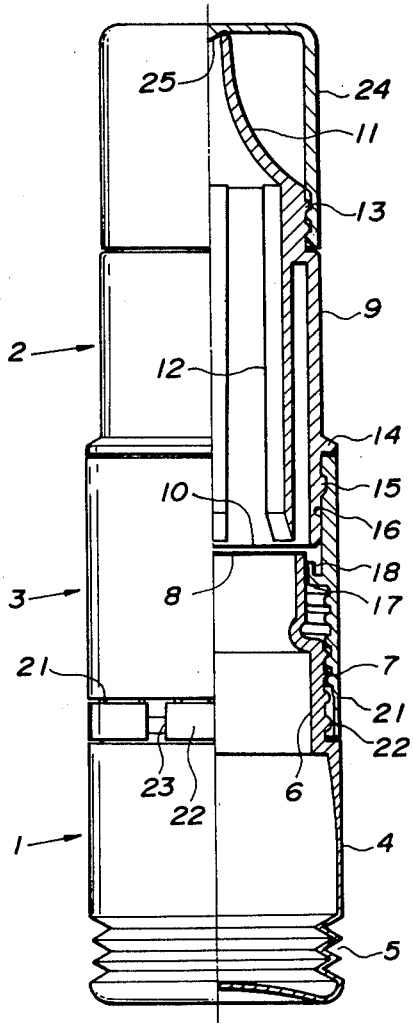
Figure 2:
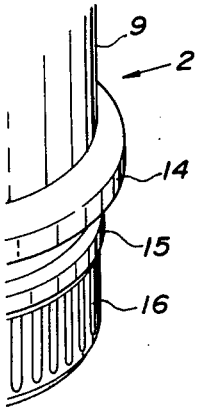
Figure 3:
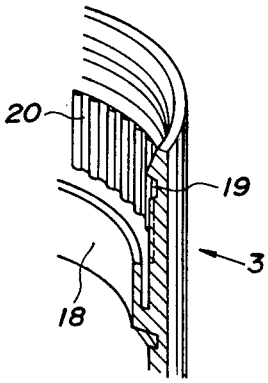

A two-part liquid container with a breakable partition of the first embodiment of the present invention shown in FIGS. 1 to 3 is constructed, as shown, to couple and hold a first upper half container 1 to a second lower half container 2 via an intermediate cylindrical member 3.

The first half container 1 has a bellows telescopic portion 5 which elongates or shrinks in an elevational direction at the lower part of a body 4, spiral threads 7 formed on the outer lower peripheral part of a neck portion 6, and a thin collapsible sheet 8 made of an aluminum foil or the like is bonded to the top surface of the neck portion 6 for tightly sealing the interior of the first half container 1 from all liquids.

The second half container 2 has a body 9 which includes an inner diameter larger than that of the neck portion 6, a thin collapsible sheet 10 made of an aluminum foil or the like for tightly sealing the bottom opening of the lower end of the body 9 from all liquids, a port 11 formed to extend upwardly in a nozzle shape from the top of the body 9, a plurality of cutting blades 12 circumferentially provided to extend from the top inner periphery of the body 9 to the vicinity of the lower end of the body 9 to be disposed inside the neck portion 6 spiral threads 13 formed on the outer upper periphery of the body 9, an engaging projection 14 formed on the lower outer periphery of the body 9, an engaging projection 15 formed on the lower outer periphery slightly removed from the projection 14, and a number of engaging vertical threads 16 formed in the peripheral direction as shown in FIG. 2 on the lower outer periphery of the projection 15.

The intermediate cylindrical member 3 has a guide peripheral wall 18 formed to slidably contact with the upper half part of the outer peripheral surface of the neck pertion 6 of the first half container 1 through an inward flange 17 formed on the inner periphery of the intermediate part, a number of engaging recess grooves 19 formed on the upper inner periphery for engaging with the threads 15 of the second half container 2, a number of vertical engaging grooves 20 formed on the lower inner peripheral surface of the grooves 19 for engaging with the vertical threads 16, spiral threads formed on the lower inner half periphery of the guide peripheral wall 18 for engaging with the threads 7, and short cylindrical sealing piece 22 connected via skipped collapsible pieces 21 from the lower peripheral edge. Reference numeral 23 designates a knob of the pieces 22. Reference numeral 24 designates a cap which has a projection 25 formed at the center on the back surface of the top wall for sealing the upper opening of the part 11, and spiral threads formed on the lower inner periphery of the wall for engaging with the threads 13.

In the two-part liquid container thus constructed, the recess grooves of the member 3 are engaged with the threads 15, and the grooves 20 are engaged with the threads 16, thereby engaging the upper half part of the member 3 with the lower part of the second half container 2. In this state, the threads 7 of the neck portion 6 of the first half container 1 are engaged with the threads of the member 3, thereby engaging the first half container 1 with the lower half part of the member 3. Thus, as shown in FIG. 1, the first and second half containers 1 and 2 are coupled in the stacked state. The entire container is transported, stocked and handled in this coupled state.

In order to mix two liquids in the two-part liquid container the piece 22 is exfoliated by folding the knob 23 and collapsing the piece 21. Then, the member 3 is gripped and is turned to spirally move the member 3 toward the first half container 2. Subsequently, the second half container 2 is integrated with the member 3 and is accordingly moved downwardly integrally with the member 3. The sheet 10 of the second half container 2 is collapsed at the port of the first half container 1 due to this movement of the second half container 2, and the sheet 8 of the first half container 1 is broken by the ends of the cutting blades 12. Accordingly, the liquid in the second half container 2 is dropped and transferred into the first half container 1, thereby mixing the two liquids contained respectively in the first and second half containers. The portion 5 is elongated due to the transfer of the liquid. Thereafter, the mixed liquid may be removed by removing the cap 24.

Figure 4:
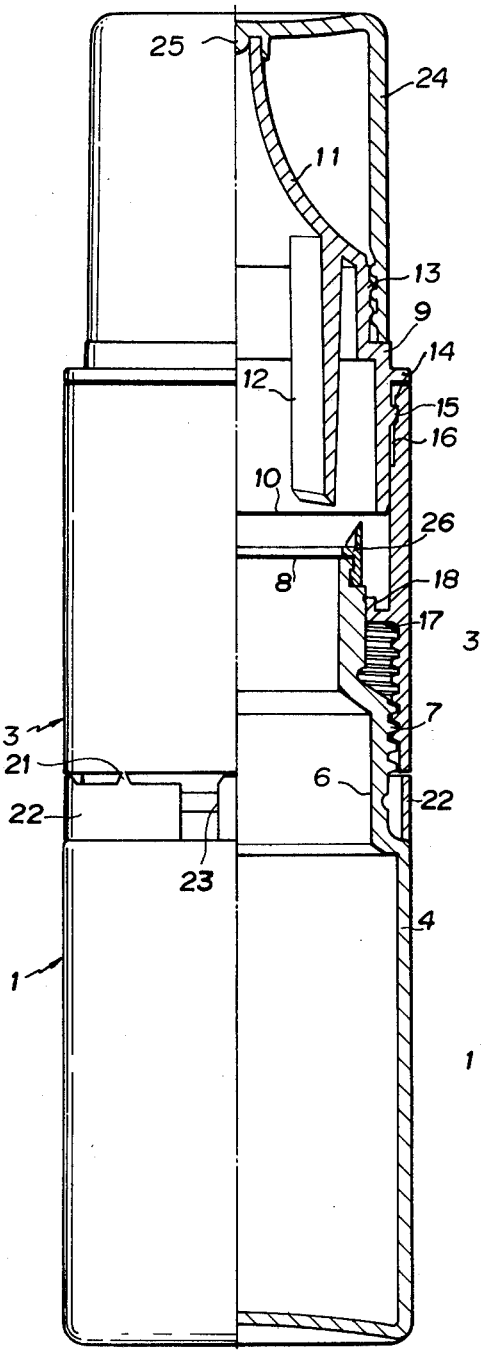
Figure 5:
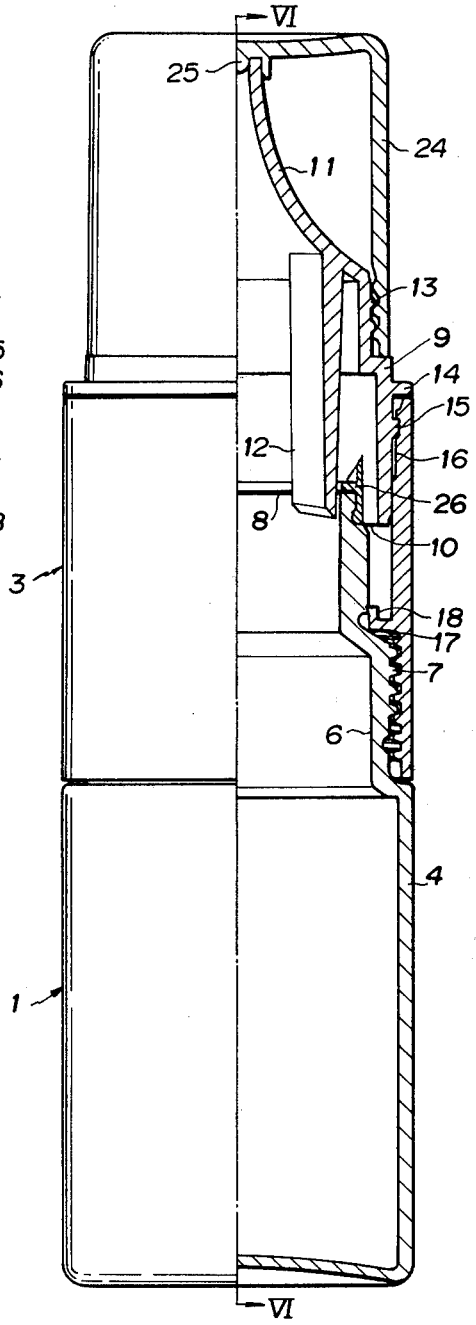
Figure 6:
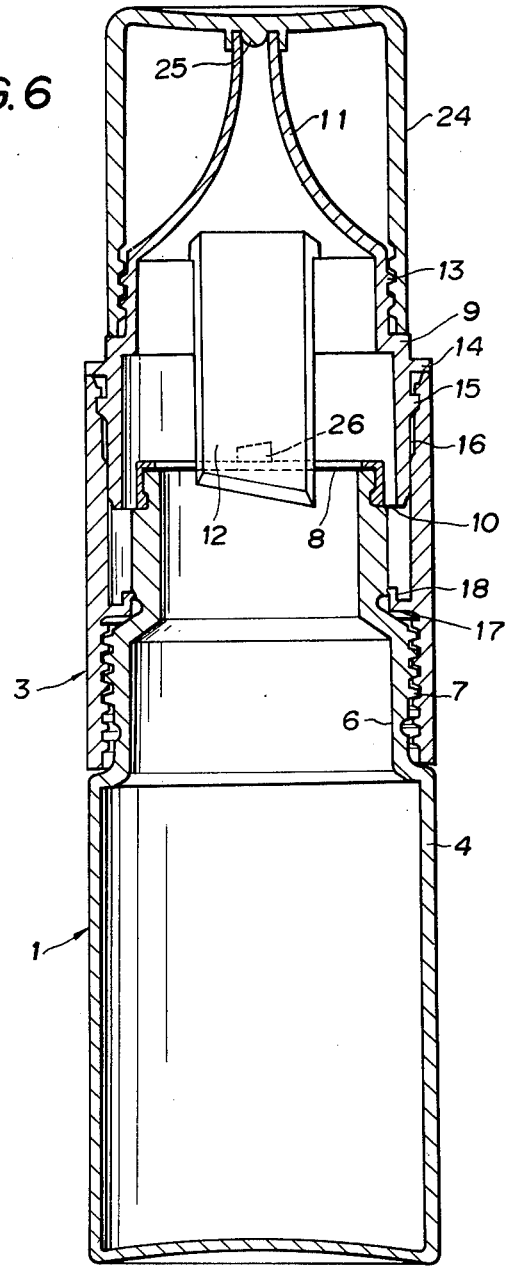

FIGS. 4 and 5 show second embodiment of the two-part liquid container with a breakable partition according to the present invention. A pawl-shaped sheet collapsing member 26 is engaged with the top of the neck portion 6 of the first half container 1 for collapsing or breaking the sheet of the second half container 2. This member 26 is formed with a sharp shape at one end to readily collapse or break the sheet by the simple spiral movement of the member 3.

The member 26 is either rigidly engaged with the outer top periphery of the first half container 1 or a projection is formed at an arbitrary position on the inner lower periphery of the member 26 and a swelled part (not shown) for engaging the projection is formed on the outer peripheral surface of the top, constructed so as to fix the member 26 to the port.

The cutting blade 12 which is disposed inside the neck portion 6 from the inner upper periphery of the body 9 and extends to the vicinity of the lower end of the body 9 comprises a cutting blade member having a suitable width (substantially ⅓ of the circular periphery) in the peripheral direction, comprises a sharp shape at the end, and is inclined from one end toward the other end. In this manner, the sheet 8 of the first half container 1 can be readily collapsed or broken. The other structure is constructed in the same manner as the first embodiment of the present invention.

According to present invention as described above, since the two liquids can be mixed merely by spirally moving the member 3, it is not necessary to prepare a particular mixing container and it is possible to perform complicated filling operation without overflowing even one droplet of liquid and observe whether the two liquids are already mixed or not at a glance.

What is claimed is:

1. A liquid container:

a first container comprising a substantially enclosed body, a first neck portion with an opening, threads formed on said first neck portion, and a first collapsible or breakable sheet fluidly sealing the opening of said first neck portion to retain liquid within said first container;

a second container comprising a substantially enclosed body, a second neck portion with a first opening, threads formed on said second neck portion, and a second collapsible or breakable sheet fluidly sealing the opening of said second neck portion to retain liquid within said second container;

an intermediate member comprising means for threadably engaging said threaded first neck portion of said first container at one end thereof and threadably engaging said threaded second neck portion of said second container at the other end thereof;

first means for collapsing or breaking said second collapsible or breakable sheet of said second container as said first container threadably engages said intermediate member;

second means for collapsing or breaking said first collapsible or breakable sheet of said first container as said second container threadably engages said intermediate member.

2. A liquid container as claimed in claim 1 wherein said first and second collapsible or breakable sheets each are made of aluminum foil.

3. A liquid container as claimed in claim 1 wherein said second container further comprises a second opening for removing or inserting a substance into or out of said second container.

4. A liquid container as claimed in claim 3 wherein said second container further comprises a cap for fluidly sealing said second opening of said second container.

5. A liquid container as claimed in claim 1 wherein said first means for collapsing or breaking said second collapsible or breakable sheet further comprises a first member for collapsing or breaking said second collapsible or breakable sheet of said second container wherein said first member is disposed at said first neck portion of said first container.

6. A liquid container as claimed in claim 1 wherein said second neck portion of said second container further comprises an inner diameter larger than an outer diameter of said first neck portion of said first container.

7. A liquid container as claimed in claim 3 wherein said first opening of said second container is of a nozzle shape.

8. A liquid container as claimed in claim 1 wherein said second means for collapsing or breaking said first collapsible or breakable sheet further comprises a second member for collapsing or breaking said first collapsible or breakable sheet of said first container wherein said second member is disposed within said second container.

9. A liquid container as claimed in claim 1 with said first and second means for collapsing or breaking said first and second collapsible or breakable sheets comprising a plurality of cutting blades.

10. A liquid container as claimed in claim 8 with said second means for collapsing or breaking said first collapsible or breakable sheet comprising a second member for collapsing or breaking said first collapsible or breakable sheet comprising a width substantially ⅓ of the diameter of said first container.

11. A liquid container as claimed in claim 8 wherein said second member comprises a sharp edge which collapses or breaks said first collapsible or breakable sheet.

12. A liquid container according to claim 1 wherein said first container is formed with a telescopic bellows portion capable of elongating or shrinking axially at one end of the first container opposite said first neck portion.

* * * * *